US006866442B1

(12) United States Patent
Petersen

(10) Patent No.: US 6,866,442 B1
(45) Date of Patent: Mar. 15, 2005

(54) AIRCRAFT SERVICE PIT T-HANDLE LATCH

(75) Inventor: Craig A. Petersen, Costa Mesa, CA (US)

(73) Assignee: Dabico, Inc., Costa Mesa, CA (US)

( * ) Notice: Subject to any disclaimer, the term of this patent is extended or adjusted under 35 U.S.C. 154(b) by 0 days.

(21) Appl. No.: 10/849,403

(22) Filed: May 20, 2004

(51) Int. Cl.[7] ..... E02D 29/14

(52) U.S. Cl. ..... 403/326; 404/25; 292/143; 220/324

(58) Field of Search ... 403/326–330; 404/25; 292/143; 220/315, 324; 210/164

(56) References Cited

U.S. PATENT DOCUMENTS

| | | | |
|---|---|---|---|
| 945,753 | A | 1/1910 | Chamberlain et al. |
| 2,009,132 | A | 7/1935 | Gehris |
| 2,693,100 | A | 11/1954 | Wiegel |
| 4,739,896 | A | 4/1988 | Moss |
| 5,056,955 | A | 10/1991 | Spiess et al. |
| 5,082,392 | A | 1/1992 | Marchese et al. |
| 5,324,135 | A | 6/1994 | Smith |
| 5,335,451 | A | 8/1994 | Druzynski |
| 5,366,317 | A | 11/1994 | Solimar |
| 5,507,590 | A | 4/1996 | Argandona |
| 5,600,921 | A | 2/1997 | Vardaro |
| 6,199,414 | B1 | 3/2001 | Chang |

*Primary Examiner*—Christopher J. Novosad
(74) *Attorney, Agent, or Firm*—Charles H. Thomas

(57) ABSTRACT

A latch assembly is provided for an aircraft service pit having a lid frame formed with an access opening encompassed within an upwardly facing bearing ledge. The pit lid has a flat upper surface and is hinged at one edge at a horizontal axis of rotation relative to the lid frame. The pit lid has an opposite, latching edge. A latch mechanism is mounted on the latching edge of the pit remote from the horizontal axis of rotation and includes a latch mount embedded in the structure of the pit lid. The latch mount defines a latch guide path inclined downwardly from the flat upper surface of the pit lid and outwardly toward the latching edge thereof. A latch bolt, preferably having a T-shaped handle, is reciprocally mounted for movement in the latch guide path. The latch bolt preferably has a gripping end formed as a T-shaped handle that is accessible from the flat upper surface of the pit lid. The latch bolt also has an opposite, distal, bearing ledge-engaging end. A spring is compressed between the latch mount and the distal end of the latch bolt so as to urge the distal end of the latch bolt into engagement with a lip located at the underside of the seating rim formed by the bearing ledge of the pit lid support frame.

14 Claims, 5 Drawing Sheets

AIRCRAFT SERVICE PIT T-HANDLE LATCH

BACKGROUND OF THE INVENTION

1. Field of the Invention

The present invention relates to a latching mechanism for an access lid to a subsurface chamber for servicing aircraft.

2. Description of the Prior Art

At modern aircraft terminals the servicing of aircraft on the ground is frequently performed using subsurface pits, which are often prefabricated structures. Such aircraft servicing pits are installed at aircraft docking, fueling, and loading areas beneath the surface of the tarmac across which aircraft travel during docking and departure maneuvers. The pits form a subsurface chambers and are typically constructed of fiberglass, steel, concrete, or aluminum. These pits are often constructed as complete enclosures with surrounding walls, a floor, and an access lid at the top seated within a frame disposed about the neck of the prefabricated pit. When the lid is closed it lies substantially flush with the surface of the tarmac. Such pits are installed below the surface of loading and refueling aprons at aircraft terminals, remote parking locations, and aircraft maintenance bases.

The purpose of the pits is to allow ground support functions to be carried out from subsurface enclosures. These ground support functions include the provision of fuel, the provision of electricity to an aircraft while it is in the docking area, the provision of air for cooling the aircraft interior, the provision of pressurized air for starting the aircraft engines, and for other aircraft support activities on the ground. The use of subsurface pits eliminates the need for mobile trucks, carts, and other vehicles which are otherwise present in the loading area and which interfere with each other and with the arrival and departure of aircraft in the vicinity of a loading gate.

The use of subsurface pits also allows the provision of fuel, power, cooling and pressurized air, and other supplies from a central location. The necessary fluid supplies and electrical power can be generated or stored with a greater efficiency at a central location, as contrasted with mobile generating or supply vehicles.

The pits located below the aircraft terminal area house valves, junction boxes, cooling air terminations, and other terminal equipment that is temporarily connected to an aircraft that has been docked. Umbilical pipes and lines, otherwise housed within the pits, are withdrawn from them through hatches therein and are coupled to a docked aircraft to supply it with fuel, air for cooling the aircraft interior, pressurized air for starting the engines, and electrical power.

The pits are constructed with either hinged or totally removable lids that can be moved between open positions allowing access to the pits and closed positions which are flush with the surfaces of the docking, loading, or refueling areas across which aircraft travel and beneath which the pits are mounted. To ensure that the pit lids remain flush with the surrounding surfaces, it is desirable to employ a latching mechanism. Very typically such a latching mechanism involves a catch depending from the underside of the edge of the pit lid remote from the hinge about which the pit lid is rotatably mounted to its surrounding frame. The catch engages a latch bar secured to the interior wall of the pit. The catch is normally moved in rotation about a horizontal axis by means of a lever arm located in a cavity at the underside of the pit lid remote from the axis at which the pit lid is mounted to the frame. Access to the latch actuating mechanism to operate the lever arm is normally provided in a handgrip pocket cavity in the upper surface of the pit lid.

To open the pit lid the user inserts the fingers of one hand into the cavity in the pit lid. The user then presses upwardly on the latch actuating mechanism, thereby rotating the lever arm. The lever arm and catch mechanism operate in the manner of a bell crank, so that rotation of the latching mechanism lever arm pulls the catch from beneath the latch bar and allows the user to open the pit lid. One prior mechanism of this type is described in U.S. Pat. No. 4,739,896, which is hereby incorporated by reference in its entirety.

In some circumstances pits without latching mechanisms have been installed beneath docking and undocking locations as air terminals. However, it has subsequently been determined that some type of positive latching mechanism is either necessary or highly desirable at such locations. Latch mechanisms typically require a particular type of configuration of the pit lid when the pit lid is initially fabricated. However, once the pit lid has been installed, it has been quite difficult to retrofit the pit lid with a latch mechanism since pit lids without latch mechanisms typically have different configurations than pit lids originally designed to be equipped with latch mechanisms.

Many conventional pit latching systems require one or more of the latch mechanism components to be mounted on the interior wall of the buried pit. However, in subsurface aircraft serving pits originally designed to be used without a latch mechanism there is often equipment or other structure already in the pit, either at the location at which the internally mounted latch component would have to be installed or in such a location as to obstruct installation of the necessary component. In either case, it is often extremely difficult, if not impossible to retrofit existing pits with conventional pit latching mechanisms.

SUMMARY OF THE INVENTION

The present invention provides a unique latching mechanism for an aircraft service pit lid that readily lends itself to retrofitting in aircraft servicing pit lids not originally designed to be equipped with latch mechanisms. The present invention is a T-latch mechanism that can be retrofit installed in an existing aircraft service pit lid. Thus, according to the present invention, an aircraft servicing pit lid originally lacking a latch mechanism may be provided with a simple, but reliable, latching mechanism that prevents a pit lid from being opened without actuation of the latching mechanism.

One object of the invention is to provide an existing subsurface aircraft servicing pit lid with a latch mechanism that can be installed in the field at an existing pit installation without requiring removal of the pit lid and without requiring any portion of the latch mechanism to be installed within the pit itself.

Another object of the invention is to provide an aircraft servicing pit lid latching mechanism that can be retrofitted onto an existing aircraft servicing pit installation and which does not require any component of the latching mechanism to be physically mounted to either the structure of the pit itself or to the lid supporting frame located atop the pit. By providing a pit lid latching mechanism with components installed only on the pit lid itself, problems of interference or obstruction in the latch mechanism installation by existing equipment within the pit are avoided.

A further object of the invention is to provide an aircraft servicing pit lid latch assembly that can be retrofitted onto an existing, aircraft servicing pit lid and which has components all located at or below the level of the upper surface of the pit lid. Thus, the latch assembly avoids any problems of components protruding above grade when the pit lid is closed.

In one broad aspect the present invention may be considered to be an improvement in a pit lid assembly for an aircraft servicing subsurface pit enclosure. Such an enclosure is buried beneath the ground surface across which aircraft travel while on the ground. A pit enclosure of this type employs a pit lid support located atop the subsurface pit enclosure. The pit lid support defines an access opening to the pit enclosure surrounded by an inwardly projecting lid supporting rim with a lip defined therebeneath. A pit lid having an upper surface and a hinge leaf is hinged to the pit lid support. The pit lid is thereby alternatively movable to a closed position seated upon the lid supporting rim and an open position exposing the access opening.

According to the improvement of the invention a pit lid latch assembly is mounted in the pit lid remote from the hinge leaf. The pit lid latch assembly includes a latch mount with a passageway defined therein, a latch member disposed for longitudinal, reciprocal movement within the passageway, and a biasing mechanism. The passageway defined in the latch mount is inclined downwardly from the upper lid surface and outwardly away from the hinge leaf. The latch member has a proximal end with a grip thereon, accessible from the upper surface of the pit lid, and an opposite distal end. The biasing mechanism urges the distal end of the latch member away from the upper surface of the pit lid and away from the hinge leaf. The biasing mechanism, unless overcome by an opposing force, forces the distal end of the latch member beneath the lip of the supporting rim when the pit lid is in the closed position.

Preferably the latch mount is a block having an undersurface with a cavity defined therein. The latch mount block is oriented in such a manner that the passageway for the latch member is inclined at an angle of about fifty-one degrees relative to the plane of the upper surface of the pit lid. The latch member is preferably a rod with a spring retainer at its distal end. The biasing mechanism is preferably a coil spring disposed coaxially about the rod and compressed between the spring retainer and the undersurface of the latch mount block. The grip is preferably formed as a T-shaped handle. A limit stop may be provided on the latch member to limit its movement in a direction away from the upper surface of the pit lid.

The latch member may be configured as a T-shaped structure, the stem of which is a rod having a cylindrical outer surface with a pair of radial, annular channels defined therein. One of these channels is located at the proximal end of the rod, while the other is located at the distal end. The spring retainer and the limit stops are formed as C-clips secured in these channels.

The latch assembly of the invention is designed for retrofit installation on an installed pit lid that is provided with an edge recess in its upper surface. Such an edge recess is typically a part of a handgrip pocket defined at the edge of the pit lid remote from the hinge. The structure of the pit lid at the lower surface of the edge recess may be removed using a blow torch, for example. Once a hole has been created through the pit lid at the edge recess, the latch mount mounting block is installed in position and welded in the opening created through the pit lid so that the latch member passageway is at the proper angle of inclination relative to the upper surface of the pit lid. The latch mount is thereby disclosed in the edge recess. The biasing mechanism urges the grip at the proximal end of the latch member to a location beneath the level of the upper surface of the pit lid.

In another broad aspect the invention may be considered to be an aircraft servicing pit lid assembly for a subsurface aircraft servicing pit enclosure buried beneath the ground surface across which aircraft travel during docking and undocking. The aircraft servicing pit lid assembly of the invention is comprised of a pit lid support, a pit lid, a pit lid latch guide, an latch bolt, and a resilient spring. The pit lid support is designed for use atop a pit enclosure and has a flat upper surface. The pit lid support defines a lid seating ring recessed beneath the flat upper surface and having an underside. A hinge seating pocket is defined in the structure of the pit lid support and is located immediately adjacent one side of the lid seating ring.

The pit lid is configured to seat within the confines of the pit lid support upon the seating ring. The pit lid has a hinge leaf projecting laterally into the hinge pocket. A hinge coupling between the hinge leaf and the pit lid support joins the pit lid to the pit lid support so that the pit lid is rotatable relative to the pit lid support. The pit lid may be moved between an open condition exposing the access opening and a closed position seated upon the seating ring.

The pit lid latch guide is located on the pit lid remote from the hinge leaf. The pit lid latch guide defines a latch passageway inclined downwardly relative the pit lid, away from the upper surface and away from the hinge leaf. The latch bolt is disposed for reciprocal, linear movement and is constrained by the latch passageway. The latch bolt has a grip end accessible from the upper surface of the pit and an opposite distal end. The distal end of the latch bolt engages the underside of the seating ring. The resilient spring urges the distal end of the latch bolt beneath the underside of the seating ring when the pit lid is closed.

In still another broad aspect the invention may be defined as a latch assembly for an aircraft servicing pit having a lid frame formed with an access opening encompassed within an upwardly facing, peripheral bearing ledge that is lower than and surrounded by a horizontal deck. A pit lid having a flat upper surface is provided. The pit lid has a hinged edge hinged at a horizontal axis of rotation to the lid frame. The pit lid also has an opposite latching edge.

The latch assembly is comprised of a latch mechanism mounted on the latching edge of the pit lid, remote from the horizontal axis of rotation. The latch mechanism includes a latch mount defining a latch guide path inclined downwardly from the flat upper surface of the pit lid and outwardly toward the latching edge thereof. A latch bolt is reciprocally mounted for movement in the latch guide path. The latch bolt has a gripping end accessible from the flat upper surface of the pit lid and an opposite, bearing ledge-engaging end. A spring exerts a biasing force on the latch bolt downwardly from the upper surface of the pit lid and outwardly from the latching edge thereof. The spring urges the bearing ledge-engaging end of the latch bolt into engagement beneath the bearing ledge.

The invention may be described with greater clarity and particularity by reference to the accompanying drawings.

DESCRIPTION OF THE EMBODIMENT

Figure 1:
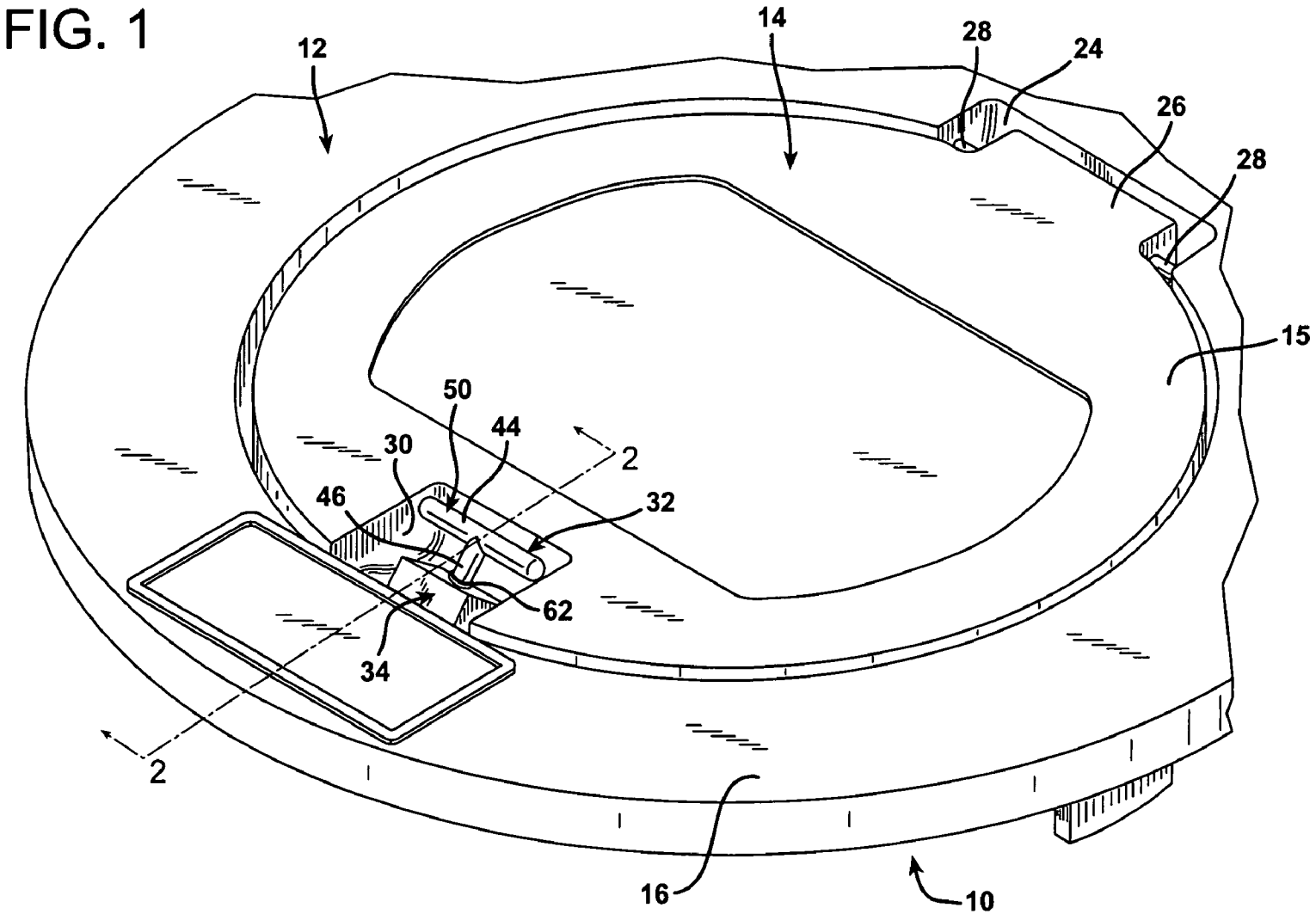
FIG. 1 is a perspective view illustrating an improved pit lid assembly according to the invention.

FIG. 1 illustrates a pit lid assembly 10 designed for use atop an aircraft service subsurface pit enclosure buried beneath a ground surface across which aircraft travel on the ground during docking and undocking maneuvers. The pit lid assembly 10 has a pit lid support 12, which in the embodiment illustrated, is an annular, generally disc-shaped structure. It is to be understood that the pit lid support 12 can have any shape. For example, pit lid supports having a generally rectangular shape with rectangular openings designed to accommodate rectangular-shaped pit lids are widely employed. However, in the embodiment of the invention illustrated, the pit lid support 12 is designed to receive and accommodate a generally disc-shaped pit lid indicated at 14.

Figure 4:
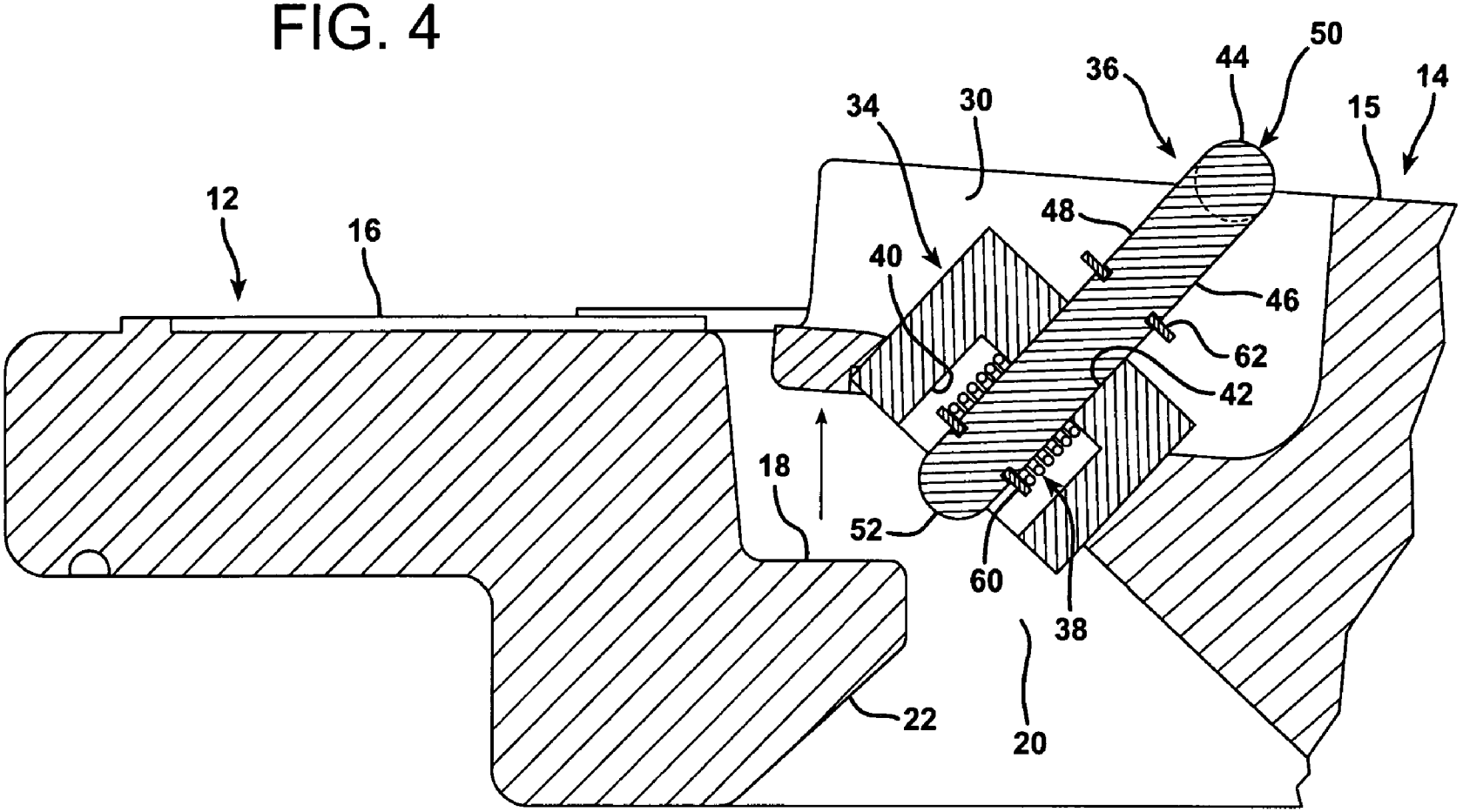
FIG. 4 is a side sectional elevational detail illustrating the commencement of movement of the pit lid from a closed position seated on the bearing ledge and an open position exposing the access opening.

As best illustrated in FIG. 4, the pit lid support 12 has flat upper surface 16 defining an annular, flat, horizontal lid seating ring 18 recessed beneath the flat upper surface 16 by a distance substantially equal to the thickness of the pit lid 14. As illustrated in FIG. 1, the pit lid support 12 also defines a hinge seating pocket 24 adjacent the lid seating ring 18.

The radially inwardly projecting lid supporting rim 18 defines an access opening 20 within its confines and also a lip 22 at its undersurface. The lip 22 is formed beneath the lid seating ring 18 and is inclined upwardly and inwardly toward the access opening 20, typically at an angle of about fifty-one degrees relative to horizontal.

The pit lid 14 is a generally disc-shaped slab of metal and is configured to seat within the confines of the pit lid support 12 upon the seating ring 18. The lid seating ring 18 serves as a bearing ledge for the pit lid 14. The pit lid 14 has a hinged edge with a hinge leaf 26 projecting laterally into the hinge pocket 24. A hinge coupling in the form of a pair of pivot pins 28 projecting transversely from the hinge leaf 26 secure the pit lid 14 in position relative to the pit lid supporting frame 12. The pit lid 14 is thereby rotatably hinged at the coupling formed by the hinge pins 28 for rotation relative to the pit lid supporting frame 12 about a horizontal axis of rotation. This horizontal axis is defined by the alignment of the hinge pins 28. The pit lid 14 may thereby be moved in rotation relative to the pit lid support 12 between an open condition exposing the access opening 20 and a closed position seated upon the seating ring 18, as illustrated in FIG. 1.

As illustrated in FIG. 1, an edge recess 30 is defined in the pit lid 14 at the latching edge of the pit lid 14 lying directly opposite the hinge leaf 26. According to the improvement of the invention, a pit latch assembly 32 is mounted in the edge recess 30 remote from the hinge leaf 26.

The pit lid latch assembly 32 is comprised of a latch mount 34, a latch member 36, and a biasing mechanism which includes a coil spring 38. The latch mount 34 is a block formed generally in the shape of a rectangular prism, as indicated in FIG. 1, but having an underside with a cavity 40 defined therein. For a pit lid 14 having an outer diameter of eighteen inches, the mounting block 34 may have an upper surface and lower surface 1.75 inches square with a cylindrical latch bolt passageway 42 defined therethrough. The latch bolt passageway 42 may have a diameter of 0.53 inches. The passageway 42 is inclined downwardly away from the flat upper pit lid surface 15 and away from the hinge leaf 26 at an angle of about fifty-one degrees relative to the flat upper lid surface 15, as illustrated in the drawings.

Figure 5:
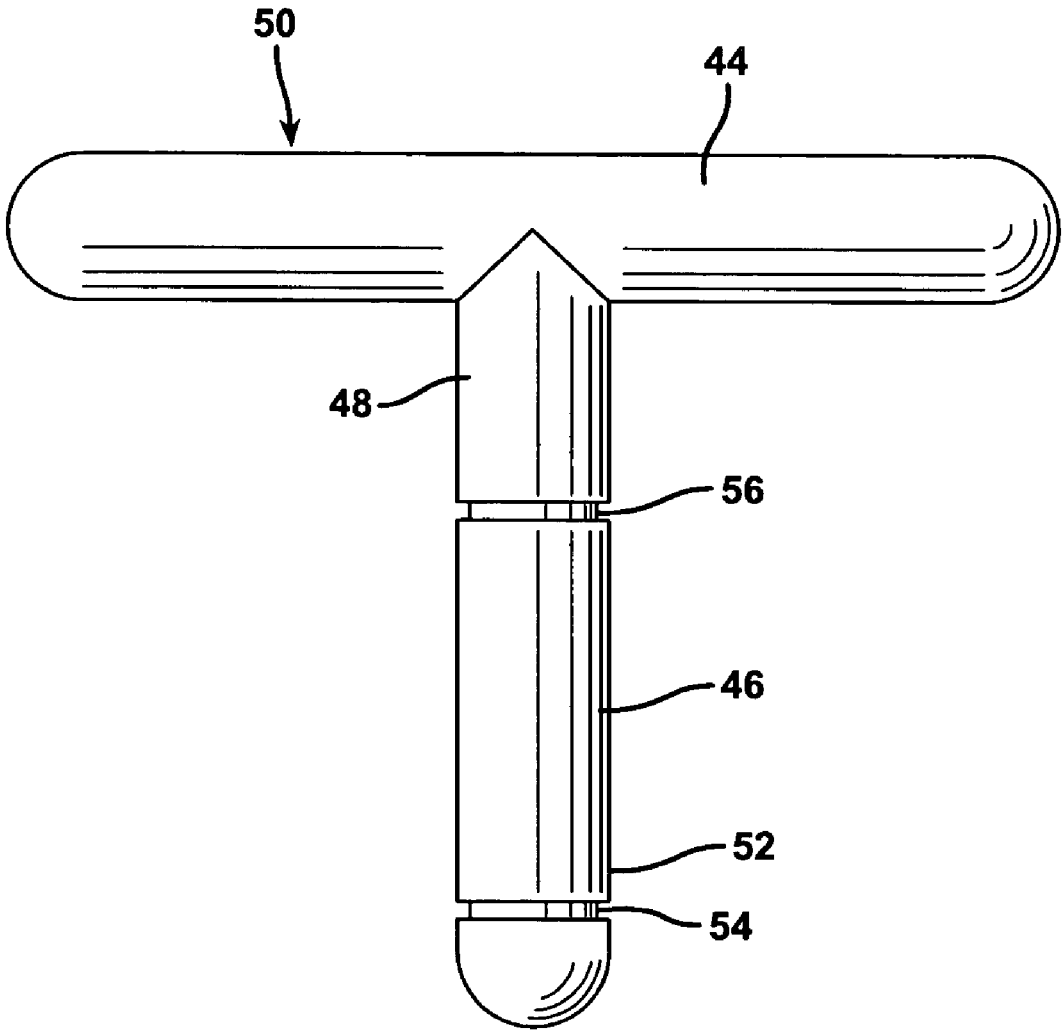
FIG. 5 is an elevational view illustrating the latch member of the latching mechanism of the invention in isolation.

The latch member 36 is formed of a pair of steel rods 44 and 46 welded together to form a generally T-shaped structure, as illustrated in FIG. 5. The latch member 36 is preferably about three inches in overall length, as measured along the axis of the latch bolt rod 46, and about 3.5 inches across, as measured between the extremities of the latch handle rod 44. The latch bolt rod 46 preferably has a diameter of 0.460 inches and extends longitudinally through the passageway 42 and is reciprocally movable in linear fashion along the passageway 42.

A pair of radial channels 54 and 56 are defined in the latch bolt rod 46. The latch member 36 has a proximal end 48 with a grip formed in the shape of a T-shaped handle 50, as best illustrated in FIG. 5. The tip of the opposite, distal end 52 of the latch bolt rod 46 is rounded and the radial, annular channel 54 is defined therein. The other radial, annular channel 56 is defined in the proximal end 48 of the latch bolt rod 46. The channels 54 and 56 are each about 0.055 inches in width.

Figure 2:
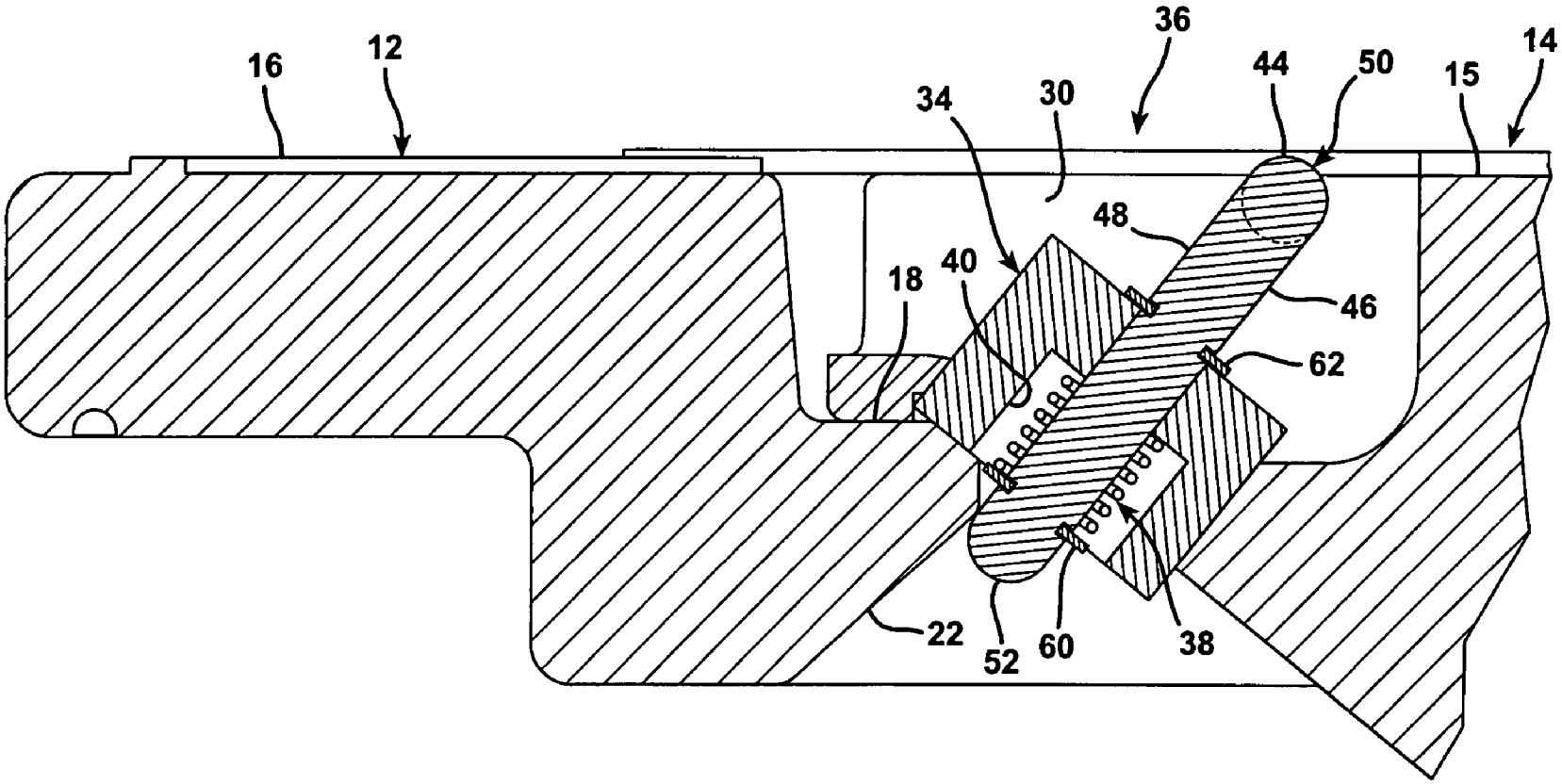
FIG. 2 is a side sectional elevational detail taken along the lines 2—2 of FIG. 1 and illustrating the latch mechanism of the invention in an engaged position.
Figure 3:
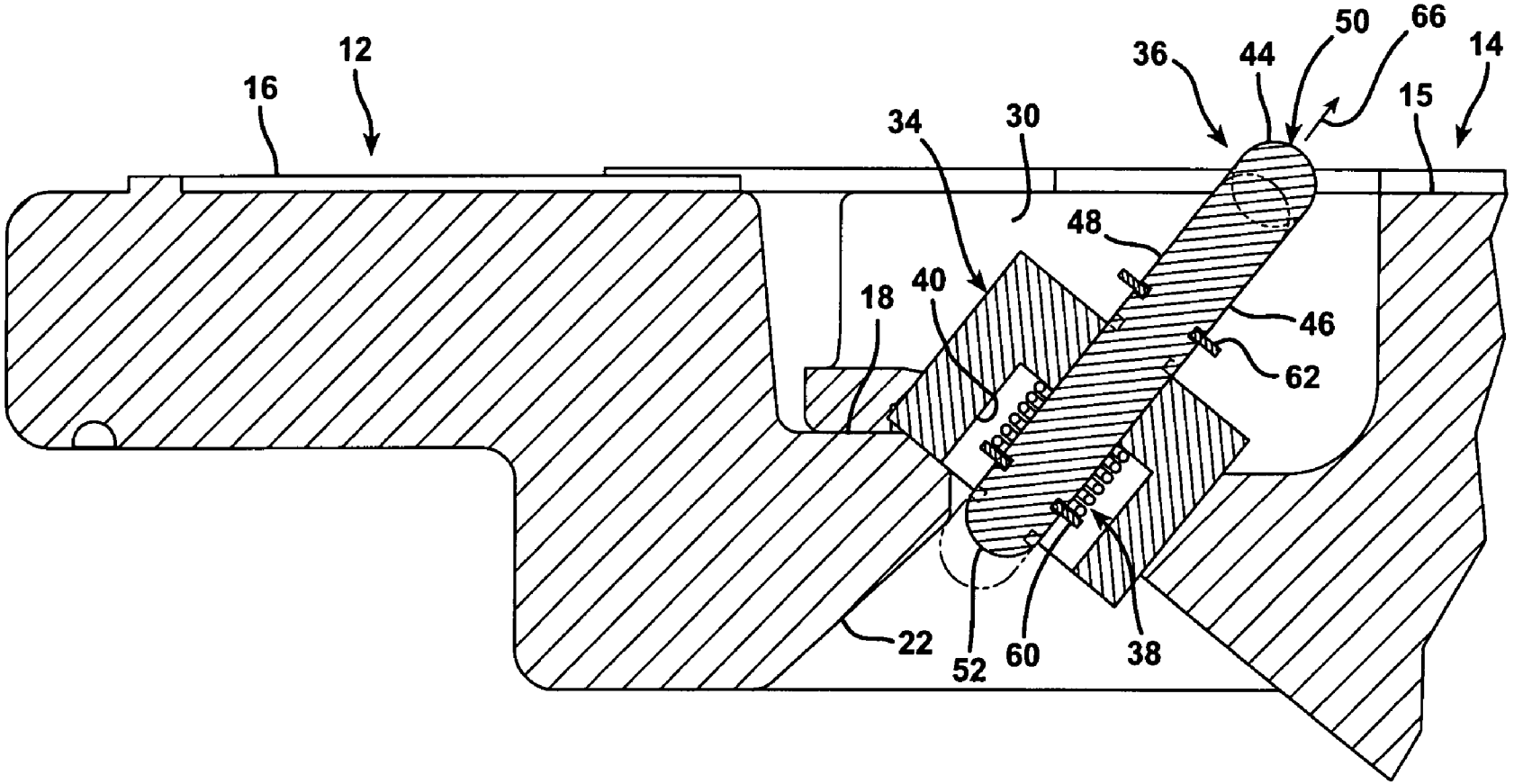
FIG. 3 is a side sectional elevational detail illustrating the commencement of disengagement of the latch mechanism.

The spring 38 is a compressed coil spring that is disposed coaxially about the latch bolt rod 46 at the distal end 52 thereof. A spring retainer C-clip 60 is engaged in the lower radial groove 54 at the distal end 52 of the latch bolt rod 46. The coil spring 38 is compressed between the lower spring retainer C-clip 60 and the undersurface of the mounting block 34, as illustrated in FIGS. 2, 3, and 4. Another spring retainer C-clip 62 is fastened in the other channel 56 of the latch bolt 46 above the top surface of the mounting block 34. The C-clip 62 serves as a limit stop on the latch member 36 to limit movement of the latch member 36 in a direction away from the upper surface 15 of the pit lid 14.

The latch assembly 32 is utilized in the manner illustrated in FIGS. 2, 3, and 4. When the pit lid 14 resides in the closed position, seated upon the seating ledge 18, the compressed coil spring 38, unless overcome by an opposing force, urges the distal end 52 of the latch member bolt 46 downwardly and outwardly in a direction away from the flat upper surface 15 of the pit lid 14 and away from the hinge leaf 26. When the pit lid 14 is in its seated position illustrated in FIGS. 1 and 2, the distal end 52 of the latch bolt rod 46 projects beneath the edge of the lip 22 at the undersurface of the pit lid supporting rim 18. When the latch assembly 32 of the invention is in the condition illustrated in FIGS. 1 and 2, the tip of the latch bolt rod 46 engages the lip 22 and holds the pit lid in a closed position, seated upon the pit lid supporting rim 18. It should be noted that, in this condition, the T-shaped handle 50 at the gripping end 48 of the latch bolt rod 46 projects upwardly from the latch recess 30 no higher than the plane of the upper pit lid surface 15. With the latching mechanism 32 in the condition illustrated in FIGS. 1 and 2, the pit lid 14 is held shut in its closed position by the engagement of the distal end 52 of the latch bolt 46 with the lip 22.

When it is desired to open the pit lid 14, the user stands in the vicinity of the hinge pocket 24 of the pit lid supporting frame 12 and grips the ends of the transverse crossbar 44 of the T-shaped handle 50 and pulls up on the handle 50 of the latch member 36 in the inclined direction indicated by the directional arrow 66 in FIG. 3. This force overcomes the biasing force of the spring 38, as illustrated in FIG. 3, to draw the distal end 52 of the latch bolt rod 46 out of engagement with the lip 22. Further continued force exerted along the line 66, which is applied along the centerline of the latch bolt rod 46, allows the latch bolt rod 46 to be drawn out of engagement with the lip 22 at the underside of the seating ring 18 of the pit lid support frame 12. Continued application of this force, in the direction indicated by the directional arrow 66, causes the pit lit 14 to be rotated from its closed position, shown in FIGS. 1 and 2, to an open position exposing the entire access opening 20.

When the T-shaped handle 50 at the gripping end 48 of the latch member 36 is released, the force of the coil spring 38 draws the latch bolt rod 46 back down into the passageway 42. The limit stop 62 limits the longitudinal downward and outward movement of the latch bolt 46 so that the coil spring 38 always remains at least partially compressed.

To close and latch the pit lid 14, the user again lowers the pit lid 14 while gripping the T-shaped handle 50. The pit lid 14 is rotated back down into a horizontal disposition, as illustrated in FIG. 3. The latch member 36 is then released so that the coil spring 38 forces the latch bolt 46 downwardly and outwardly, away from the upper surface 15 of the pit lid 14 and away from the hinge leaf 26. The tip of the latch bolt 46 thereupon reengages the lip 22 to hold the pit lid 14 in a shut condition, as illustrated in FIGS. 1 and 2. The latch bolt 46 will engage the lip 22 whether or not the handle 50 is released before the pit lid hits the seating ledge 18.

The upper annular channel 56 at the proximal end 48 of the latch member bolt 46 is close enough to the transverse crossbar 44 so that the T-shaped handle 50 is drawn down into the recess 30 at the latching edge of the pit lid 14 and below the level of the upper surface 15 of the pit lid 14, as illustrated in FIG. 2. The T-shaped handle 50 is thereby located below grade so that it poses no safety hazard to individuals walking across the surface below which the pit enclosure is buried, nor can it damage the wheels of a vehicle or any cart or other object traveling across the ground surface.

Undoubtedly, numerous variations and modifications of the invention will become readily apparent to those familiar with latching mechanisms for aircraft servicing pits. For example, while a coil spring has been illustrated as the biasing mechanism of the invention in the embodiment depicted, it is to be understood that some other resilient biasing mechanism might be employed. For example, a compressible rubber sleeve could be substituted for the coil spring 38. Also, other types of grips such as, knobs or L-shaped handles could be substituted for the T-shaped handle 50 employed in the embodiment illustrated. Accordingly, the scope of the invention should not be considered limited to this specific embodiment illustrated and described, but rather as defined in the claims appended hereto.

I claim:

1. In a pit lid assembly for an aircraft servicing subsurface pit enclosure buried beneath a ground surface across which aircraft travel while on the ground, and having a pit lid support located atop said subsurface pit enclosure defining an access opening to said pit enclosure surrounded by an inwardly projecting lid supporting rim with a lip defined therebeneath, and a pit lid having an upper surface and a hinge leaf hinged to said pit lid support, whereby said pit lid is alternatively movable to a closed position seated upon said lid supporting rim and an open position exposing said access opening, the improvement comprising:

a pit lid latch assembly mounted in said pit lid remote from said hinge leaf and including:

a latch mount with a passageway defined therein which is inclined downwardly away from said upper lid surface and outwardly away from said hinge leaf, a latch member disposed for longitudinal, reciprocal movement within said passageway and having a proximal end with a grip thereon accessible from said upper surface of said pit lid and an opposite, distal end, and a biasing mechanism urging said distal end of said latch member away from said upper surface of said pit lid and away from said hinge leaf, whereby said biasing mechanism, unless overcome by an opposing force, forces said distal end of said latch member beneath said lip when said pit lid is in said closed position.

2. A pit lid assembly according to claim 1 wherein said latch mount is a block having an undersurface with a cavity defined therein, and said latch member is a rod with a spring retainer at said distal end thereof, and said biasing mechanism is a coil spring disposed coaxially about said rod and compressed between said spring retainer and said undersurface of said block.

3. A pit lid assembly according to claim 2 wherein said grip is formed as a T-shaped handle.

4. A pit lid assembly according to claim 3 further comprising a limit stop on said latch member to limit movement of said latch member in a direction away from said upper surface of said pit lid.

5. A pit lid assembly according to claim 4 wherein said latch member has a cylindrical outer surface with a pair of radial, annular channels defined therein, one at said proximal end and the other at said distal end, and said spring retainer and said limit stops are formed as C-clips secured in said channels.

6. A pit lid assembly according to claim 1 wherein said passageway is oriented at an angle of about 51 degrees relative to said upper surface of said pit lid.

7. A pit lid assembly according to claim 1 wherein said pit lid is provided with an edge recess in said upper surface thereof and said latch mount is disposed in said edge recess, whereby said biasing mechanism urges said grip at said proximal end of said latch member to a location beneath the level of said upper surface of said pit lid.

8. An aircraft servicing pit lid assembly for a subsurface aircraft servicing pit enclosure buried beneath a ground surface across which aircraft travel during docking and undocking, comprising:

a pit lid support for use atop said pit enclosure and having a flat upper surface and defining a lid seating ring recessed beneath said flat upper surface and having an underside and a hinge seating pocket adjacent said lid seating ring, a pit lid configured to seat within the confines of said pit lid support upon said seating ring and having a hinge leaf projecting laterally into said hinge pocket and a hinge coupling between said hinge leaf and said pit lid support, whereby said pit lid is rotatable relative to said pit lid support between an open condition exposing an access opening and a closed position seated upon said seating ring, and a pit lid latch guide located on said pit lid remote from said hinge leaf and defining a latch passageway inclined downwardly relative to said pit lid away from said upper surface and away from said hinge leaf, a latch bolt disposed for reciprocal, linear movement and constrained by said latch passageway, wherein said latch bolt has a grip end accessible from said upper surface of said pit lid and an opposite, distal end for engaging said underside of said seating ring, and a resilient spring urging said distal end of said latch bolt beneath said underside of said seating ring when said pit lid is closed.

9. An aircraft servicing pit lid assembly according to claim 8 wherein said pit lid is provided with an edge recess opposite said hinge leaf and said pit lid latch guide is a mounting block located within said edge recess.

10. An aircraft servicing pit lid assembly according to claim 9 wherein said distal end of said spring is provided with a spring retainer and said resilient spring is a coil spring disposed coaxially about said a latch bolt and said resilient spring is compressed between said spring retainer and said mounting block and said grip end of said latch bolt is provided with a T-shaped handle.

11. And aircraft servicing pit lid assembly according to claim 8 wherein said latch passageway is inclined at an angle of about 51 degrees relative to said pit lid.

12. A latch assembly for an aircraft service pit having a lid frame formed with an access opening encompassed within an upwardly facing bearing ledge that is lower than and surrounded by a horizontal deck, and a pit lid having a flat upper surface, a hinged edge hinged at a horizontal axis of rotation to said lid frame, and an opposite latching edge, comprising a latch mechanism mounted on said latching edge of said pit lid remote from said horizontal axis of rotation and including a latch mount defining a latch guide path inclined downwardly from said flat upper surface and outwardly toward said latching edge, a latch bolt reciprocally mounted for movement in said latch guide path and having a gripping end accessible from said flat upper surface and an opposite, bearing ledge engaging end, and a spring exerting a biasing force on said latch bolt downwardly from said upper surface and outwardly from said latching edge to urge said bearing ledge-engaging end of said latch bolt into engagement beneath said bearing ledge.

13. A latch assembly according to claim 12 wherein said pit lid has an edge recess defined therein at said latching edge, said latch mount is a mounting block disposed in said edge recess beneath the level of said flat upper surface, and said latch guide path is oriented at an angle of about 51 degrees relative to said flat upper surface.

14. A latch assembly according to claim 13 wherein said spring is a coil spring compressed between said latch mount and said bearing ledge engaging end of said latch bolt and a T-shaped handle is formed at said gripping end of said latch bolt.

* * * * *